United States Patent [19]

Kuhnen

[11] 4,104,960

[45] Aug. 8, 1978

[54] RECYCLE PAPER COLLECTION RECEPTACLE DEVICE

[76] Inventor: W. Scott Kuhnen, P.O. Box 489, Yuba City, Calif. 95991

[21] Appl. No.: 824,891

[22] Filed: Aug. 15, 1977

[51] Int. Cl.[2] ..... B65B 13/06

[52] U.S. Cl. ..... 100/25; 100/34; 211/50

[58] Field of Search ..... 100/1, 2, 34, 25, 8; 211/50

[56] References Cited

U.S. PATENT DOCUMENTS

| | | | |
|---|---|---|---|
| 2,364,518 | 12/1944 | Clouser | 100/34 |
| 2,636,432 | 4/1953 | Sherer | 100/34 |
| 2,639,037 | 5/1953 | Friend | 100/34 X |
| 3,038,403 | 6/1962 | Orelind | 100/34 |
| 3,491,681 | 1/1970 | Saro | 100/34 |
| 3,933,088 | 1/1976 | Pessagno | 100/34 |
| 3,983,799 | 10/1976 | Paul | 100/34 |

*Primary Examiner*—Billy J. Wilhite

*Attorney, Agent, or Firm*—David H. Semmes; Warren E. Olsen

[57] ABSTRACT

A recycle paper collection receptacle device comprising a longitudinally extending shelter, with a superposed roof structure and removal access doors to protect newspapers deposited within bays that are aligned on both sides of a center partition. The present invention is an improved form of receptacle for newspapers, in that it is manifestly well suited for use in a public place, with protection against the elements and inadvertent loss of newspapers by wind and other causes. An additional feature of the present invention is the use of an arcuate slotted channel defined by a metal tube which extends inwardly from a point on each bay which is exposed even when the doors are mounted upon side partitions between adjacent bays. The arcuate slotted channel is a metal tube which allows an operator to bale the collected newspapers even with the doors in place, and without need for access to the rear of the collected newspaper pile. The device further includes end walls which function as transverse roof supports while protecting the entire enclosure at either end from atmospheric hazards.

7 Claims, 5 Drawing Figures

RECYCLE PAPER COLLECTION RECEPTACLE DEVICE

BACKGROUND OF THE INVENTION:

1. Field of the Invention:

The present invention relates to newspaper or other type of paper recycling devices, and particularly one which is extremely well suited to be left unattended in a public place. The present invention represents an improvement over prior designs, in that it includes a roof structure which encloses and protects the individual bays, while not interfering in any manner with loading and unloading of the device. Additionally, the present invention is improved over prior devices in that is includes an arcuate slotted channel extending inwardly of each bay, at a point which is exposed even when the doors are mounted on center partitions defining adjacent bays.

DESCRIPTION OF THE PRIOR ART:

Numerous devices are known in the prior art for the baling or collection of newspaper, and representative of the prior art approaches of others are the United States patents, as follows:

CLOUSER; 2,364,518
SHERER; 2,636,432
FRIEND; 2,639,037
ORELIND; 3,038,403
SARO; 3,491,681
PESSAGNO; 3,933,088
PAUL; 3,983,799

The present invention is categorically distinguished from the prior art in that it has a roof enclosure, additionally having access doors and an overall design which will ensure that newspapers left within the bays will not be subject to the elements, i.e., dampened by rain or blown about by wind. The present invention is also distinct in that it allows a unitary weatherproof structure for collecting newspapers in a public place which has a plurality of receptacles aligned along a longitudinal extending center partition, with a particular form of arcuate slotted tube for easy insertion of a baling wire or strap without need for access to the back of the device.

Paul, U.S. Pat. No. 3,983,799, illustrates a collection box for recycled or waste paper that is a single vertically elongated and open front box, and his construction also includes central grooves around two sides in order to facilitate the baling of papers within.

Pessagno, U.S. Pat. No. 3,933,088, illustrates a structure for bundling waste paper which includes tubular members that are substantially U-shaped, to cross each other at right angles at the bottom of an upwardly open receptacle. The receptacle itself is defined only by the vertical arms, and this device requires a string to be inserted into both of the tubes, drawn through a slot, and then tied at the top. Thereafter, the bundle must move upwardly.

Sherer, U.S. Pat. No. 2,636,432, illustrates another box-like receptacle having a front wall with a vertical gap. According to this construction, string for baling the contents of the receptacle extends from the top of one wall across the bottom and up the other wall. Again, the device of Sherer requires the operator to remove the baled bundle upwardly, and there is no provision for protecting the papers in an outdoor environment.

Friend, U.S. Pat. No. 2,639,037, illustrates another form of cabinet for storing and baling waste paper. The upward portion of the cabinet is again basically box-like, though without a top and front wall. Sides and bottoms are grooved, which extend from edge to edge in order to receive the string, to facilitate the tying of a bundle after sufficient paper has accumulated.

Orelind, U.S. Pat. No. 3,038,403, illustrates another prior art device which has a floor or box-like container that includes essentially four corner space from each other. Again the papers must be removed vertically, since none of the side panels are removable to protect the newspapers while being bundled, and removed for egress of the baled pile.

Clouser, U.S. Pat. No. 2,364,518, illustrates that it is known to employ a box for stringing and baling paper. The sides of his box have a plurality of slots to accommodate a string, though again his device requires a vertical removing of bundled newspapers, and access to all four sides in order to tie off the bundle which has been collected and baled.

SUMMARY OF THE INVENTION

The present invention relates to a particularly improved form of recycled paper collecting receptacles, and one which is particularly well adapted for outdoor use and simplicity of operation. The present invention teaches an improved construction wherein a superposed roof structure extends in a longitudinal direction, and is supported by vertically extending end walls which are transverse to a longitudinal and vertically disposed center partition member which divides the receptacle into two sets of bays. Adjacent bays are defined by a plurality of vertically disposed side partitions which extend transversely from either side of the center partition, with removable access doors releasably mounted on each outer end of the transverse partition. All of the bays are covered by the superposed roof, and protected at either longitudinal end by the vertically extending end wall.

The present invention is exceptional in that it includes a slotted metal tube as an arcuate slotted channel which extends inwardly from a point on the base of the device which is exposed even when the doors are mounted upon each of the side partitions. This arcuate channel extends inwardly therefrom, to below said base of each bay and through a curved transition to a vertical upward end, along the outwardly facing side of the center partition portion which defines each bay.

Accordingly, a feature of the present invention is the ability to allow the public to load newspapers into each of the bays, without worry that the assembled newspapers or the like will be damaged by the elements. The superposed roof structure, the end walls, and the removable access doors combinatively protect the newspapers, all without hampering the unloading operation.

In order to unload stacks of newspapers within any given bay, the operator need only insert a banding material into an arcuate slotted channel which is open in the vicinity of the base of each bay, between and exposed by access doors on adjacent center partitions. The arcuate channel is a slotted metal tube, with the slot being on the concave side of the tube. The tube extends inwardly from the outward extent of each bay, below the base of each individual bay and through a curved transition and then vertically upward along the outwardly facing side of the portion of the center partition which defines that particular bay. In this manner the insertion of a wire requires no access to the back of the center partition since the arcuate channel is extending below the bays in a smooth arc and upwardly against the visible face of the center partition. In this fashion, the operator can bale the stack of newspapers without the necessity of either removing the access doors, or gaining access to the back of the partition for threading the baling strap through a channel. Because the arcuate channel is below a groove in the base of each individual bay, there is no interference with the bottom-most newspaper and the threading operation.

The access doors are defined by vertically elongated panels having a positive latching mechanism at their upper ends, with their lower ends adapted for engagement into the base of the receptacle itself. The doors are symmetrically mounted about each of the transversely extending side partitions, wherein further the width of each of the doors is less than half the distance between adjacent side partitions. In other words, when all the access doors are securely latched in place, there will be an access space defined for each bay in the vicinity of the vertically extended slotted channel. This slotted space allows a person to simply lift the package of newspapers over the upper ends of the access doors, and lower them down to as low as necessary within the bay. Alternatively, the vertical space in the vicinity of the center of each bay allows a person to turn the newspapers sidewardly, and place them easily on the preexisting stack of newspapers within each bay.

The access doors need only be removed after the bays have been loaded, and baled by the insertion of a baling strap simply into either the outward end of the arcuate slotted channel, or downwardly from the vertically extending upper end of the arcuate channel. In either case, there is no need to thread the band from behind the bay, since the curved channel facilitates threading of the strap without need for further alignment.

Therefore, it is an object of the present invention to provide a newspaper collection receptacle device which is particularly well suited for outdoor use, since it is protected against the vagaries of the elements.

A related object of the present invention is an outdoor receptacle for collecting newspapers for recycling which does not require the removal of access doors prior to unloading, for the baling of the stack of newspapers within each bay. The access doors are securely latched at their upper ends, and function to protect the newspapers from wind and related hazards, while also defining a convenient vertical opening for visibly ascertaining the amount of newspapers or loading the newspapers by the public. Other advantages and features of the present invention will become more apparent from the detail description which follows, wherein reference is made to the accompanying drawings.

Figure 1:
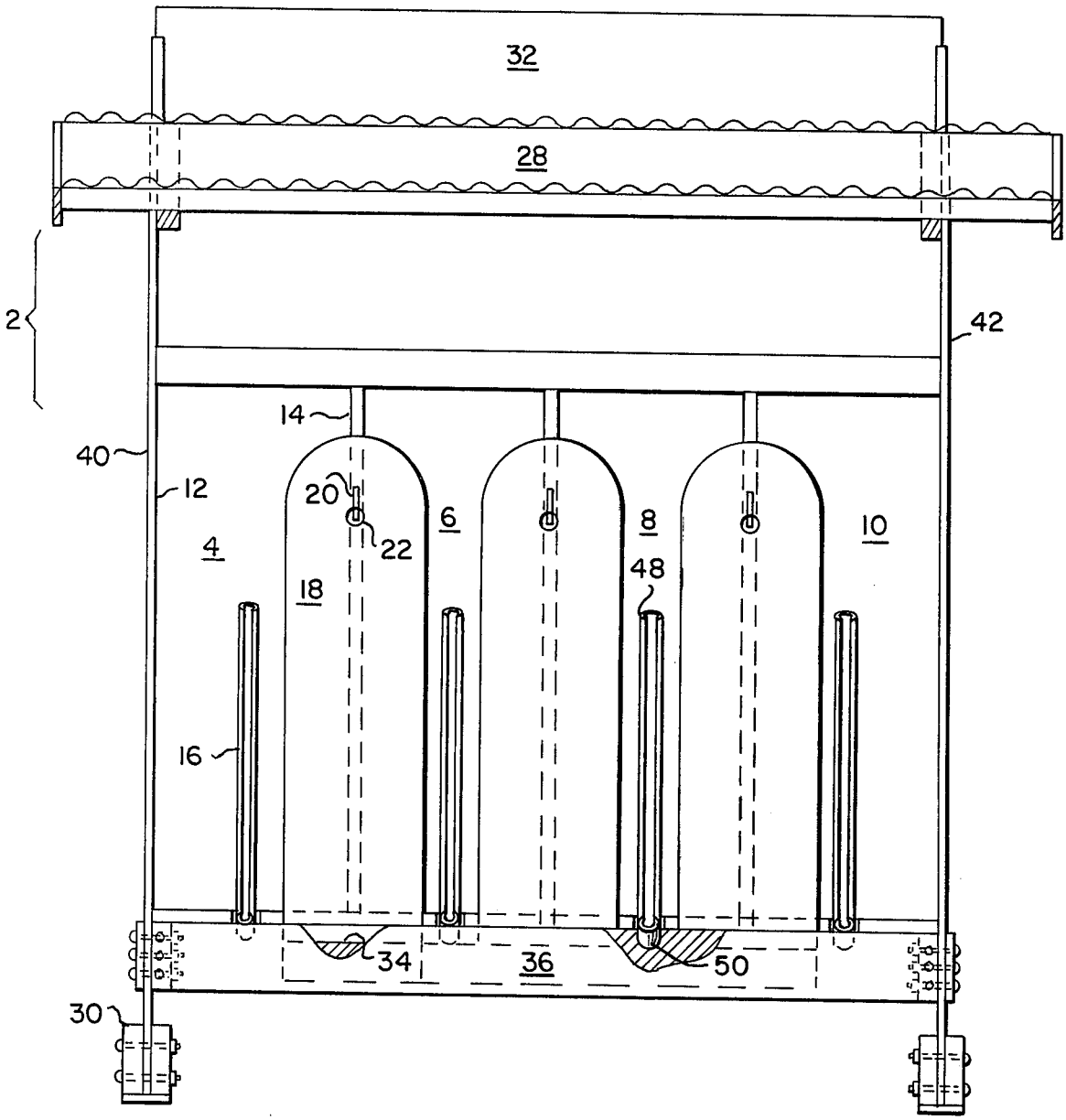
FIG. 1 is a front view, partially in section, schematically showing the preferred embodiment of the present invention.

The preferred embodiment to the present invention is illustrated in front plan view, at FIG. 1. The recycled paper collection receptacle device, 2, is a longitudinally extending shelter which has a plurality of individual bays, with four of the bays on one side being shown at 4, 6, 8, and 10. The enclosure is defined by two end walls, 40 and 42, which extend vertically upwardly from a base member, 36. The base, 36, is preferably mounted upon a skid assembly, 30, to allow the entire device to be conveniently moved on a parking lot, for example. The shelter is longitudinally extending, and the roof, 28, preferably has a peak extending along the longitudinal plane of symmetry of the device, with an overhang extending transversely to a point substantially beyond the outward extent of the bays. In the preferred embodiment of FIG. 1, the vertically extending first end wall, 40, both supports said roof, and supplies an inner surface, 12, for defining one of the three permanent sides of the first bay, 4. Within the first bay, 4, there is an arcuate slotted channel, 16, which extends inwardly from a point on the base, 36, that is located in a manner to be exposed even when a door is mounted upon adjacent side partitions.

As shown at FIG. 1, the exemplary access door, 18, is removably and releasably mounted upon the transverse side partition, 14, so that the door, 18, will be vertically disposed inward of the superposed roof, 28. Adjacent bays are similarly configured; for each case the outward extent of each bay being defined by the removable access doors mounted upon the transverse partition, and secured thereto by a locking system consisting of a latch mechanism, and a transversely extending bolt catch, for example, 22. The base, 36, preferably includes a slotted channel, 34, which can engage against the doors at their lower ends, whereby the doors will be symmetrically mounted about each of the side partitions. A further feature of the present invention is realized because the width of each of these doors, 18, e.g., is less than half the width of the distance between the adjacent side partitions defining each of the bays.

Figure 5:
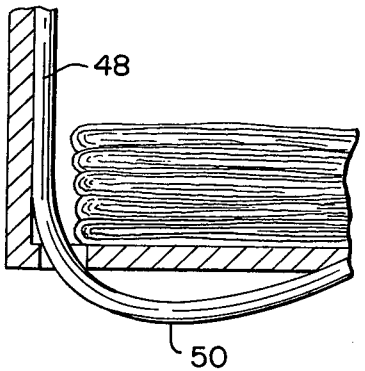
FIG. 5 is a schematic illustration showing, in section, the cooperation of the base of the bay with the arcuate slotted channel.
Figure 2:
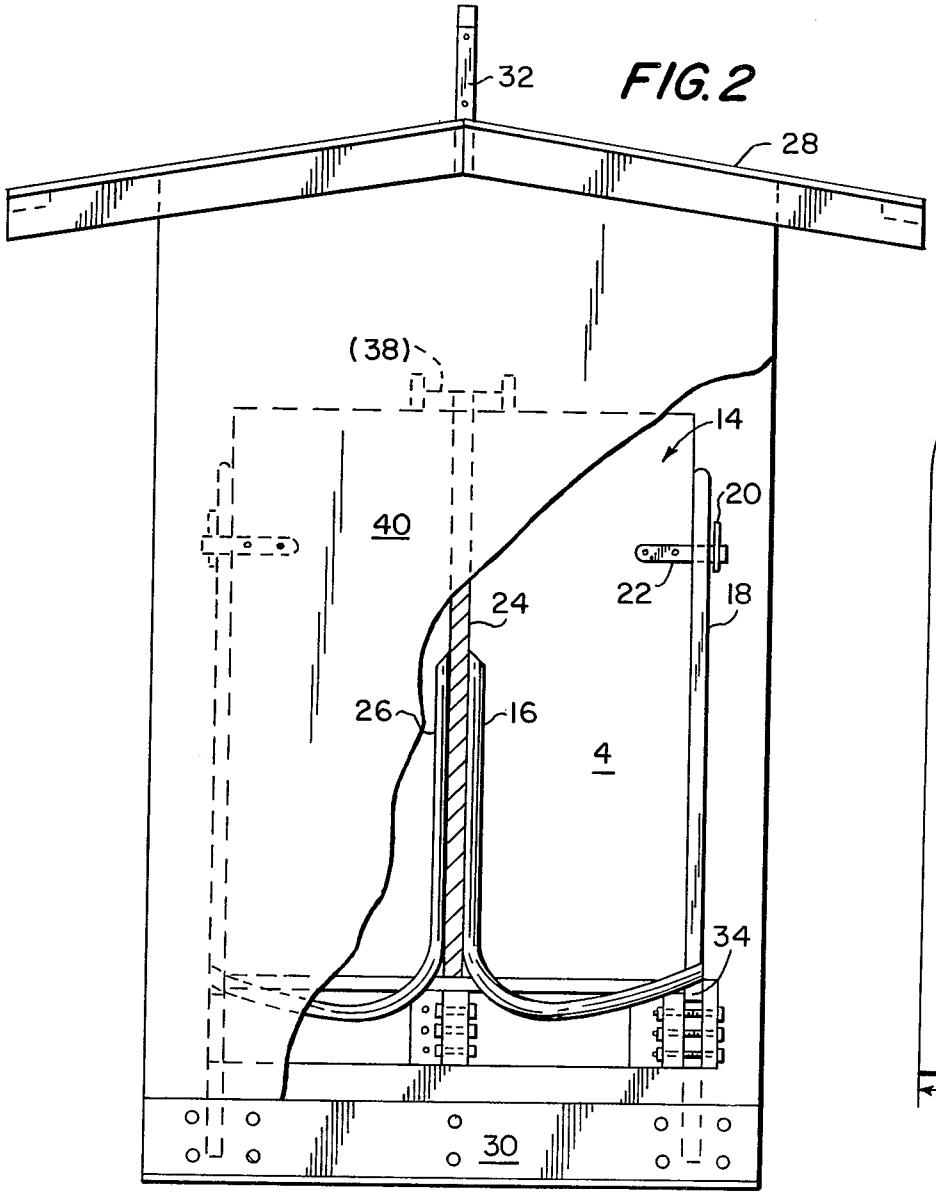
FIG. 2 is an end view, partially in section, showing the plurality of bays illustrated in front view in FIG. 1.

As shown most clearly in end view, at FIG. 2, the end wall, 40, extends vertically as a roof support, and the roof, 28, includes a ridge board which extends longitudinally along the device, at the plane of symmetry. The center partition, 24, similarly extends along the longitudinal plane of symmetry of the device, so that a plurality of bays are defined on either side of the center partition, 24. Also shown at FIG. 2 is a tray, 38, extending along the top of the center partition, 24, and this tray is provided to allow optional weights to be stored thereupon, and taken therefrom to be put upon the individual stacks of newspapers in the bays, if necessary. As a consequence of the overhanging roof structure, it is convenient to place a descriptive sign, 32, along the ridge line in order to identify the function of the device to the passing public. The sectional view through the first end wall, 40, shows that the arcuate slotted channel, 16, in the bay number 4 is opposite a similarly situated arcuate channel, 26, for the bay immediately behind the common center partition. FIG. 2 also illustrates that the exemplary vertically disposed side partition, 14, extends only partly up from the base so that there is an open area between the top of the partition, 14, and the overhanging eave of the roof, 28. In this fashion, deposit of newspapers within each of the bays is facilitated, since they may be simply lifted over the upper end of each of the exemplary access doors, 18 and dropped or guided downwardly between the access doors onto the floor of the base within each individual bay. The individual bays are preferably 48 inches high, with a width of approximately 16½ inches, so that newspaper will be accommodated as shown in FIG. 5. FIG. 5 also illustrates that the representative slotted arcuate channel, 48, shown in FIG. 1, has a first end which begins at the outward extent of the bay and thereafter goes in an arcuate fashion below the base portion of each of the bays, to a vertically extending portion which begins at the rear intersection of the base of each bay, and the outwardly facing portion of the center partition. Accordingly, a baling or strapping material inserted in the arcuate section, 50, will be allowed to be pulled vertically upward against the bottom of the stack of newspapers, and similarly the strapping material portion within the vertically extending portion of the arcuate channel, at 48, will be allowed to be pulled inwardly around the rear side of the bale. It should be apparent that the baling operation can be accomplished around stacked papers without having to remove the papers, or removing the access doors. Only after the baling operation is complete, need the access doors be removed by unbolting the latch at the top of each vertically elongated panel, and lifting the door out of its lower engagement inside of the groove, 34, within the base of the shelter.

Figure 4:
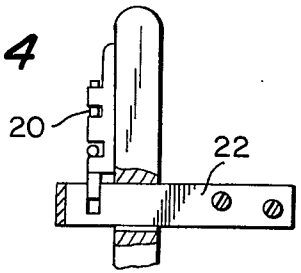
FIG. 4 is a detail showing, partially in section, of the latching mechanism in the preferred embodiment.
Figure 3:
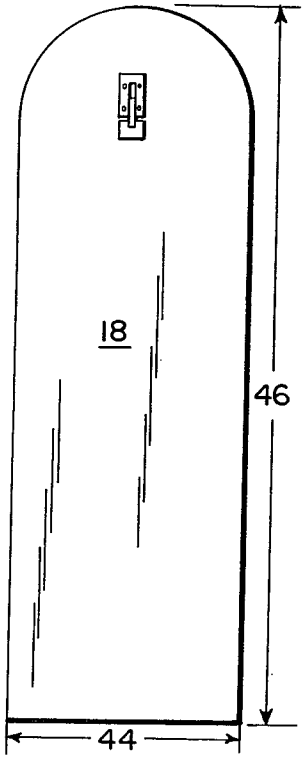
FIG. 3 is a view of one of the removable access doors used in the present invention.

As shown at FIG. 3, the individual removable access doors are preferably further defined as vertically elongated panels having rounded tops and a positive latching mechanism at their upper ends. The doors are adapted for engagement with the slot, 34, of the bays at their lower ends, and the dimension, 44, in FIG. 4 is preferably on the order of 11 inches so that when two adjacent access doors are placed on the outward ends of two adjacent center partitions, there will be an approximate 5 inch space symmetrically about the location of the slotted metal tube within each bay. A dimension 46 in FIG. 3 is preferably on the order of 44 inches, to allow convenient lifting of newspaper bales over the rounded upper edges of each door, for deposit in the individual bays.

FIG. 4 illustrates a preferred latching mechanism for each of the access doors to comprise a bolt, 20, which extends vertically downward in the extended position so as to engage a bolt catch, 22. The bolt catch, 22, is preferably a U-shaped member which is attached on both sides of a given center partition, with an access hole in the door being provided so that the doors may be simply positioned over the bolt catch, 22, and urged for secure engagement against the outward extent of each side partition.

The operation of the device should be apparent from the foregoing, and it should also be apparent that the present device affords an extremely secure outdoor paper recycle collection operation, since it is protected by a roof and the individual papers are secured against the elements by both end walls and removable access doors. Additionally, the present invention includes provision of a paper weight tray extending along the top of the longitudinally extending center partition, in order to allow convenient placement of a weight upon each of the stacks of newspapers in the bays, as required.

While various changes may be made in the invention without departing from the scope thereof, it is to be understood that the present invention is to be defined by the scope of the appended claims.

I claim:

1. A recycle paper collection receptacle, comprising:

A. a longitudinally extending shelter having a base and a superposed roof structure which extends in said longitudinal direction, said shelter further including vertically extending end walls supporting said roof, said end walls extending transversely at each end of said elongated shelter; and B. a vertically disposed center partition extending between said end walls along a longitudinal plane of symmetry for said shelter, with a plurality of vertically disposed side partitions extending transversely from either side of said center partition, thereby defining a plurality of vertically extending and outwardly open bays on either side of said center partition; wherein, C. adjacent bays further are defined at their outward extent by removable access doors releasably mounted upon each of said transverse partitions, said doors being vertically disposed and inward of said superposed roof; wherein further, D. each of said bays further includes an arcuate slotted channel extending inwardly from a point on said base which is exposed with said doors mounted upon said side partitions, said channel extending inwardly therefrom, to below said base through a curved transition and then vertically upward along the outwardly facing side of said center partition portion which defines each bay.

2. A recycle paper collection receptacle according to claim 1 wherein said superposed roof structure further comprises a roof having a peak along the longitudinal plane of symmetry of said shelter, with an overhang extending substantially beyond the outward extent of said bays.

3. A recycle paper collection receptacle according to claim 1 wherein said arcuate slotted channel further comprises an arcuate portion which is below the base portion of each of said bays, and a vertically extending portion which begins at the rear intersection of the base of said bays and the outwardly facing portion of said center partition, said base portion in each of said bays further including a slot to allow availing a strapping material inserted around stacked paper without having to remove papers residing in said bay.

4. A recycle paper collection receptacle according to claim 3 wherein said arcuate slotted channel further comprises a metal tube having a slot along its length and opening outwardly on said vertically extending portion, and upwardly on the concave portion of said arcuate portion of said tube.

5. A recycle paper collection receptacle according to claim 1 wherein each of said removable access doors are further defined by vertically elongated panels having a positive latching mechanism at their upper ends, and adapted for engagement with the base of said receptable at their lower ends, said doors being symmetrically mounted about each of said side partitions, wherein further the width of each of said doors is less than half the distance between adjacent side partitions, further said slotted channel is located midway between said side partitions in each bay; whereby newspapers to be recycled may be inserted above the upper portion of said access doors, and lowered onto said base of each bay.

6. A recycle paper collection receptacle according to claim 4 wherein said positive latching mechanism further comprises a vertically extending bolt mounted on the exterior surface said access door, and a U-shaped bolt catch extending horizontally and transversely from either side of a given center side partition, and adapted to be inserted through an opening in said access door immediately below said bolt.

7. A recycle paper collection receptacle according to claim 1 wherein said vertically disposed center partition member extends up from said base to a distance less than the height of the superposed roof, and said center partition includes a longitudinally extending tray superposed thereupon, wherein weights are operable to be placed upon said center partition and selectively put upon stacks of newspaper in each individual bay.

* * * * *